United States Patent [19]

Nakajima

[11] Patent Number: 4,865,524

[45] Date of Patent: Sep. 12, 1989

[54] VARIABLE CAPACITY COMPRESSOR

[75] Inventor: Nobuyuki Nakajima, Konan, Japan

[73] Assignee: Diesel Kiki Co., Ltd., Tokyo, Japan

[21] Appl. No.: 273,098

[22] Filed: Nov. 18, 1988

[30] Foreign Application Priority Data

Feb. 23, 1988 [JP] Japan ..... 63-41760

[51] Int. Cl.[4] ..... F04B 49/02; F04C 29/08

[52] U.S. Cl. ..... 417/295; 417/310

[58] Field of Search ..... 417/295, 310

[56] References Cited

U.S. PATENT DOCUMENTS 4,801,251 1/1989 Nakajima et al. ..... 417/295

4,818,189 4/1989 Nakajima ..... 417/295

*Primary Examiner*—William L. Freeh

*Attorney, Agent, or Firm*—Charles S. McGuire

[57] ABSTRACT

A variable capacity compressor for an air conditioning system. A passage extends between a suction chamber and a high-pressure chamber, in which is arranged a control valve device having a pressure-responsive portion displaceable in response to change in pressure within the passage. A capacity control device controls the delivery quantity of the compressor in response to opening and closing of the passage by the control valve device. The control valve device opens and closes the passage in response to change in pressure within the suction chamber representative of a thermal load on the air conditioning system to thereby cause the capacity control device to vary the delivery quantity of the compressor. An auxiliary low-pressure chamber is provided in the passage, within which the pressure-responsive portion is disposed. A restriction hole communicates the suction chamber with the auxiliary low-pressure chamber for introducing pressure within the suction chamber into the auxiliary low-pressure chamber. The compressor thus constructed can maintain substantially constant the pressure of refrigerant gas at the output of an evaporator connected to the suction chamber, irrespective of change in the thermal load on the air conditioning system, thereby preventing freeze-up of the outlet of the evaporator, during operation under a low thermal load.

4 Claims, 7 Drawing Sheets

VARIABLE CAPACITY COMPRESSOR

BACKGROUND OF THE INVENTION

This invention relates to a variable capacity compressor for compressing refrigerant for use in air conditioning systems for automotive vehicles, and more particularly to a compressor of this kind which is capable of varying the capacity thereof in response to change in the suction pressure depending upon a thermal load on the air conditioning system.

As a conventional variable capacity compressor of this kind, a vane compressor is known, e.g., from Japanese Provisional Utility Model Publication (Kokai) No. 63-99005 proposed by the present assignee, which has a control valve device arranged in a passage which communicates with a suction chamber and a high pressure chamber having discharge pressure introduced thereinto, and being operable to open and close the passage in response to change in pressure within the suction chamber depending upon a thermal load on the air conditioning system, thereby controlling the delivery quantity or capacity of the compressor.

However, according to the conventional variable capacity compressor, when it is operating with a low thermal load on the air conditioning system, discharge pressure is low and the flow rate of refrigerant gas discharged from the compressor is correspondingly low, so that the loss of pressure of refrigerant gas flowing through a hose connecting between the outlet of an evaporator and the inlet of the compressor is small. However, when the compressor is operating under a high thermal load, the flow rate of refrigerant gas discharged from the compressor increases so that the above pressure loss increases.

Further, the conventional compressor controls its capacity in response to change in the suction pressure dependent upon a thermal load on the air conditioning system. In other words, it controls its capacity so as to bring the suction pressure to a predetermined constant value, which is usually set at approximately 1.9 to 2 $kg/cm^2$, for example, in order to obtain the maximum cooling capacity of the air conditioning system at a high thermal load, as shown by the one-dot chain line (a) in FIG. 7. However, while the loss of pressure between the evaporator outlet and the compressor inlet is large at a high thermal load and accordingly the pressure of refrigerant gas at the outlet of the evaporator is much higher than that at the inlet of the compressor or suction pressure at a high thermal load, the above pressure loss is so small that the pressure of refrigerant gas at the outlet of the evaporator can be almost as low as the suction pressure of the compressor, i.e., approximately 1.9 to 2 $kg/cm^2$, which is lower than pressure at which freeze-up takes places in the evaporator, as shown by the broken line (b) in FIG. 7, thus causing the outlet of the evaporator to freeze up.

SUMMARY OF THE INVENTION

It is the object of the invention to provide a variable capacity compressor which is capable of maintaining substantially constant the pressure of refrigerant gas at the outlet of the evaporator, irrespective of change in the thermal load on the air conditioning system, thereby preventing freeze-up of the outlet of the evaporator, during operation under a low thermal load.

According to the invention, there is provided a variable capacity compressor for an air conditioning system, including a suction chamber communicating with an outlet of an evaporator of the air conditioning system, a high-pressure chamber, passage means extending between the suction chamber and the high-pressure chamber, control valve means arranged in the passage means for opening and closing same, the control valve means having pressure-responsive means displaceable in response to change in pressure within the passage means, and capacity control means responsive to opening and closing of the passage means by the control valve means for controlling the delivery quantity of the compressor, wherein the control valve means opens and closes the passage means in response to change in pressure within the suction chamber, representative of a thermal load on the air conditioning system to thereby cause the capacity control means to vary the delivery quantity of the compressor.

The variable capacity compressor according to the invention is characterized by the improvement comprising:

an auxiliary low-pressure chamber, within which the pressure-responsive means is disposed; and restriction hole means communicating the suction chamber with the auxiliary low-pressure chamber for introducing pressure within the suction chamber into the auxiliary low-pressure chamber.

According to the invention, there is also provided a wobble plate type variable capacity compressor for an air conditioning system, including a suction chamber communicating with an outlet of an evaporator of the air conditioning system, a drive shaft, a crank chamber, wobble plate means fitted on the drive shaft for swinging motion, the wobble plate means being variable in inclination angle thereof with respect to an axis of the drive shaft in response to change in pressure within the crank chamber for varying the delivery quantity of the compressor, passage means extending between the suction chamber and the crank chamber, control valve means arranged in the passage means for opening and closing same, the control valve means having pressure-responsive means displaceable in response to change in pressure within the passage means, wherein pressure within the crank chamber is variable in response to opening and closing of the passage means by the control valve means, the control valve means opening and closing the passage means in response to change in pressure within the suction chamber representative of a thermal load on the air conditioning system to thereby vary the delivery quantity of the compressor.

The wobble plate type variable capacity compressor according to the invention is characterized by the improvement comprising:

an auxiliary low-pressure chamber, within which the pressure-responsive means is disposed; and restriction hole means communicating the suction chamber with the auxiliary low-pressure chamber for introducing the pressure within the suction chamber into the auxiliary low-pressure chamber.

The above and other objects, features and advantages of the invention will become more apparent from the ensuing detailed description taken in conjunction with the accompanying drawings.

DETAILED DESCRIPTION

Figure 1:
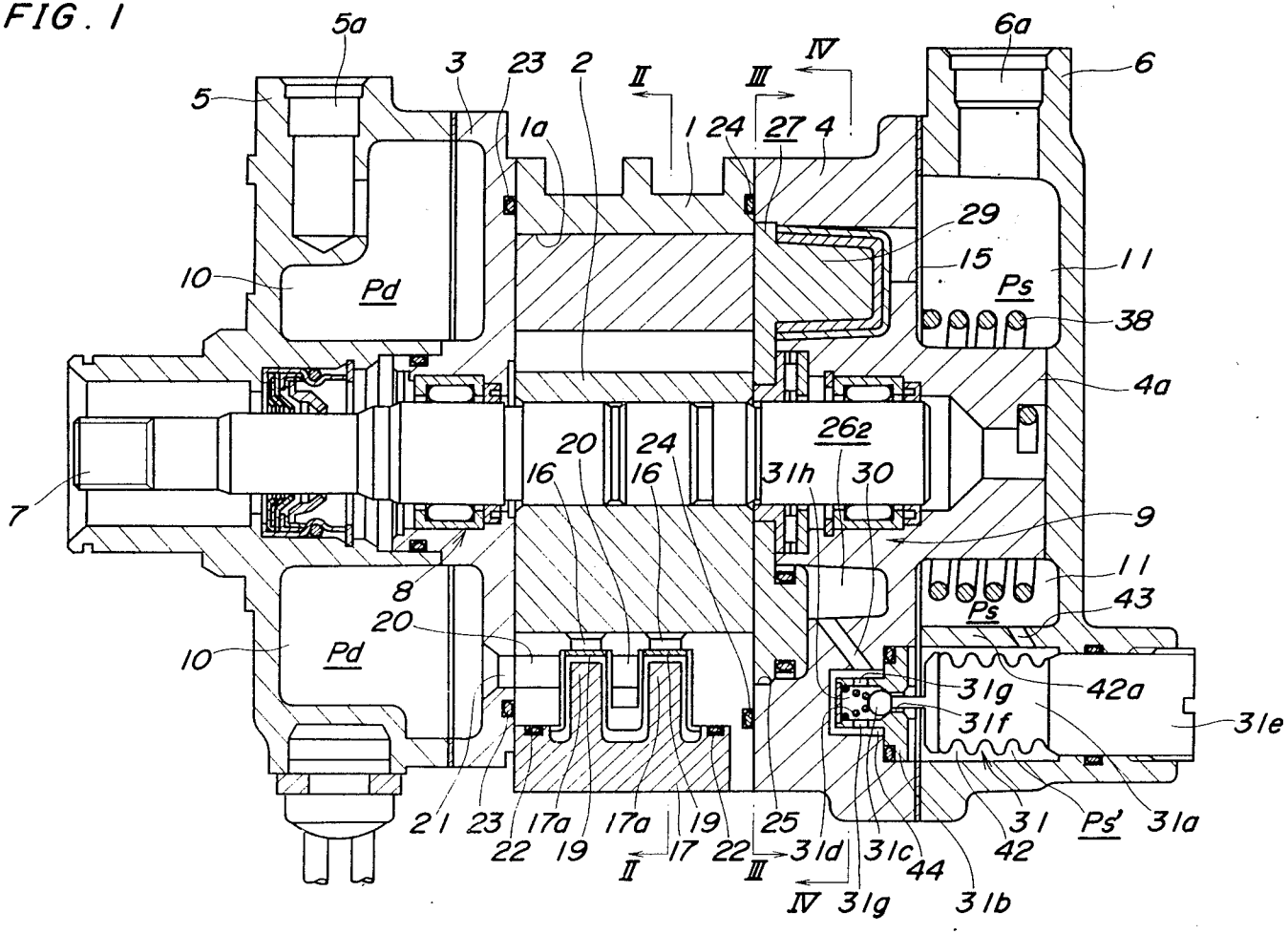
FIG. 1 is a longitudinal cross-sectional view of a variable capacity vane compressor according to a first embodiment of the invention.

The invention will now be described in detail with reference to the drawings, showing embodiments thereof. Corresponding elements and parts are designated by identical reference numerals throughout all the figures.

FIGS. 1 through 7 show a variable capacity vane compressor according to a first embodiment of the invention.

Figure 2:
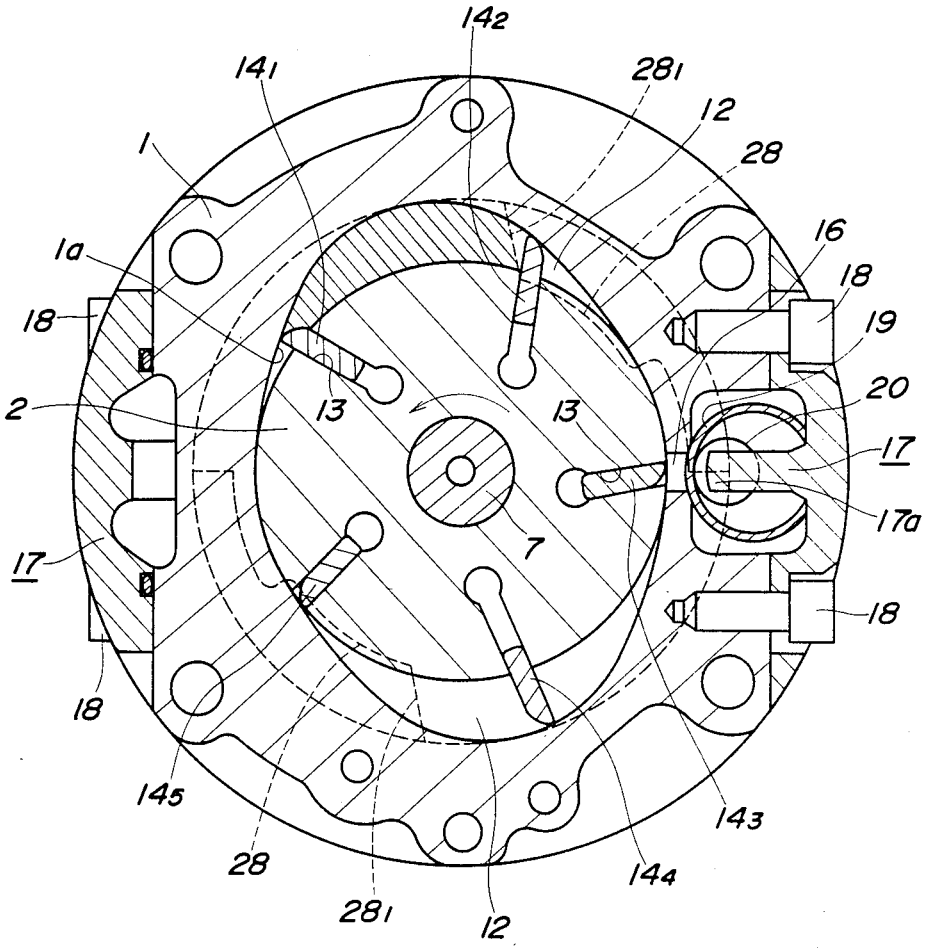
FIG. 2 is a transverse cross-sectional view taken along line II—II in FIG. 1.

Referring first to FIGS. 1 and 2, the variable capacity vane compressor is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

As shown in FIG. 2, a pair of compression spaces 12, 12 are defined at diametrically opposite locations between the inner peripheral surface 1*a* of the cam ring 1, the outer peripheral surface of the rotor 2, an end face of the front side block 3 on the cam ring 1 side, and an end face of a control element 27 on the cam ring 1 side.

The rotor 2 has its outer peripheral surface formed therein with a plurality of (five in the illustrated embodiment) axial vane slits 13 at circumferentially equal intervals, in each of which a vane $14_1$–$14_5$ is radially slidable fitted.

Figure 3:
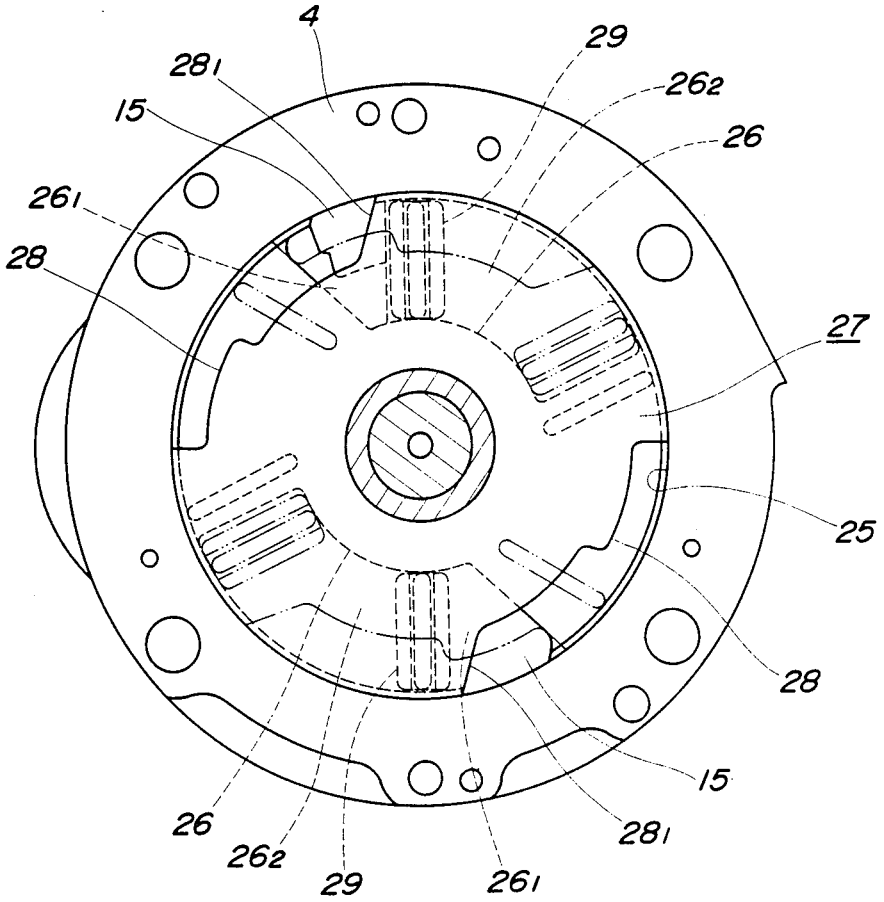
FIG. 3 is a transverse cross-sectional view taken along line III—III in FIG. 1.

Refrigerant inlet ports 15, 15 are formed in the rear side block 4 at diametrically opposite locations, as shown in FIGS. 1 and 3. These refrigerant inlet ports 15, 15 are located at such locations that they become closed when a compression chamber defined between successive two vanes $14_1$–$14_5$ assume the maximum volume. These refrigerant inlet ports 15, 15 axially extend through the rear side block 4 and through which the suction chamber 11 and the compression spaces 12 and 12 are communicated with each other.

Refrigerant outlet ports 16, 16, each port having two openings, are formed through opposite lateral side walls of the cam ring 1 at diametrically opposite locations, though only one of which is shown in FIGS. 1 and 2. The cam ring 1 has opposite lateral side walls thereof provided with respective discharge valves 19, 19, which open in response to discharge pressure to thereby open the refrigerant outlet ports 16, 16. Further formed in the cam ring 1 are a pair of passages 20 which each communicate with a corresponding one of the refrigerant outlet ports 16, 16 when the discharge valve 19 opens. A pair of passages 21 are formed in the front side block 3, which each communicate with a corresponding one of the passages 20, whereby when the discharge valve 19 opens to thereby open the refrigerant outlet port 16, a compressed refrigerant gas in the compression chamber 12 is discharged from the discharge port 5*a* via the refrigerant discharge outlet port 16, the passages 20 and 21, and the discharge pressure chamber 10, in the mentioned order.

As shown in FIGS. 1 and 3, the rear side block 4 has an end face facing the rotor 2, in which is formed an annular recess 25. A pair of pressure working chambers 26, 26 are formed in a bottom of the annular recess 25 at diametrically opposite locations.

Figure 4:
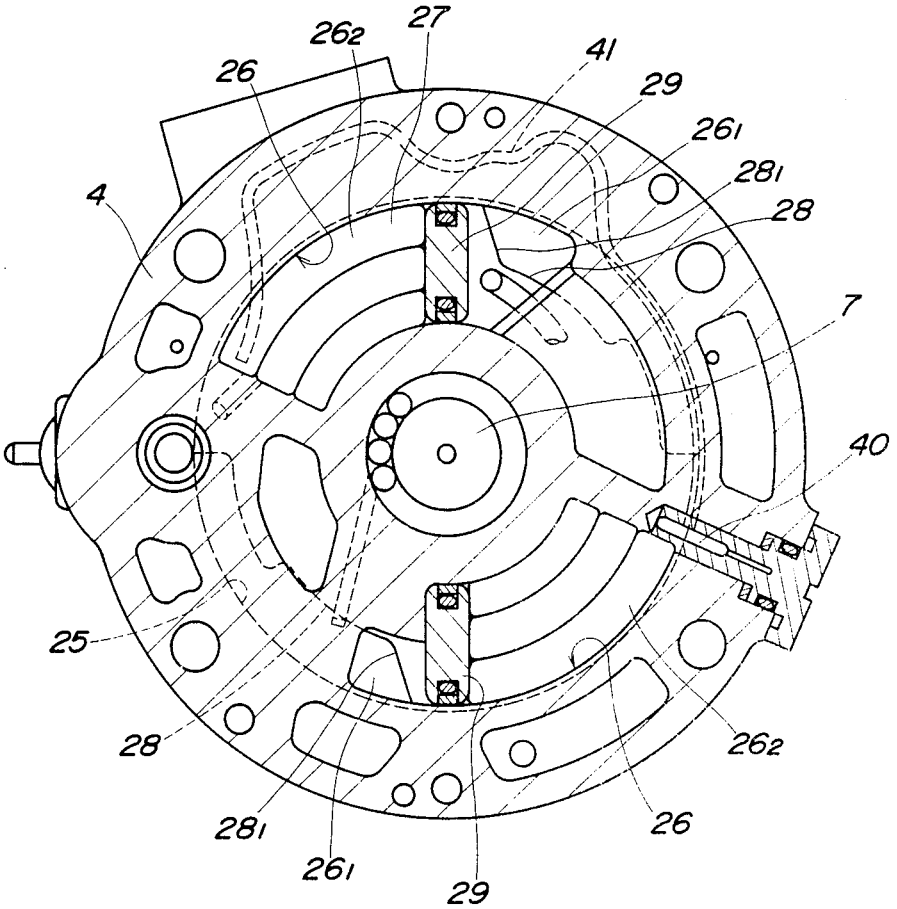
FIG. 4 is a transverse cross-sectional view taken along line IV—IV in FIG. 1.
Figure 5:
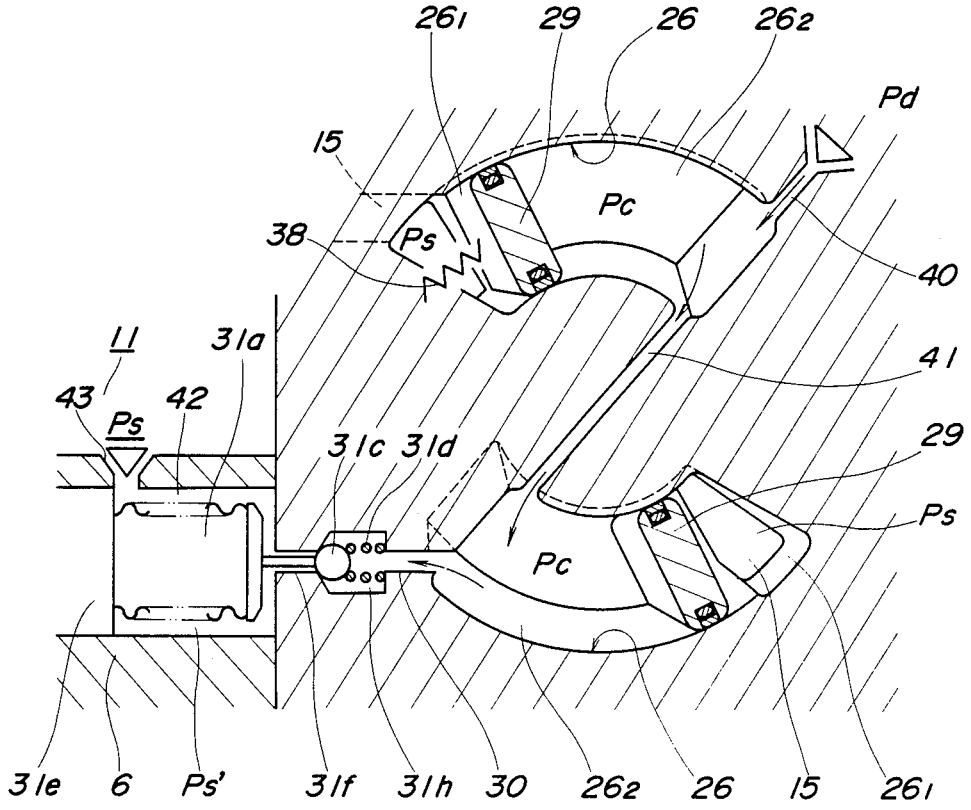
FIG. 5 is a view useful in explaining the operation of a capacity control section of the compressor.

A control element 27, which is in the form of an annulus, is received in the annular recess 25 for rotation about its own axis in opposite circumferential directions. The control element 27 has its outer peripheral edge formed with a pair of diametrically opposite arcuate cut-out portions 28, 28, and its one side surface formed integrally with a pair of diametrically opposite pressure-receiving protuberances 29, 29 axially projected therefrom and acting as pressure-receiving elements. The pressure-receiving protuberances 29, 29 are slidably received in respective pressure working chambers 26, 26. As shown in FIGS. 3 through 5, the interior of each of the pressure working chambers 26, 26 is divided into a first pressure chamber $26_1$ and a second pressure chamber $26_2$ (high-pressure chamber) by the associated pressure-receiving protuberance 29. Each of the first pressure chambers $26_1$, $26_1$ communicates with the suction chamber 11 through the corresponding inlet port 15 to be supplied with the refrigerant gas with suction pressure Ps or low pressure.

One of the second pressure chambers $26_2$, $26_2$ communicates with the passage 20 via a restriction passage 40. These second pressure chambers $26_2$, $26_2$ are communicated with each other by way of a passage 41 so that discharge pressure Pd is supplied into the both chambers $26_2$, $26_2$ to create control pressure Pc therein.

The one second pressure chamber $26_2$ is communicatable with an auxiliary low-pressure chamber 42 via a passage 30 extending between the chamber $26_2$ and the suction chamber 11 and a control valve device 31 both provided in the rear side block 4, as shown in FIGS. 1 and 5. The auxiliary low-pressure chamber 42 is defined in the rear head 6 in a manner being separated from the suction chamber 11 and communicates with the latter only through a restriction through hole 43.

The control valve device 31 is operable in response to auxiliary low pressure Ps' prevailing within the auxiliary low-pressure chamber 42 and comprises a flexible bellows 31*a* as a pressure-responsive element, a valve casing 31*b*, a ball valve body 31*c*, a coiled spring 31*d* urging the ball valve body 31*c* in its closing direction.

The bellows 31*a* is disposed within the auxiliary low-pressure chamber 42 for expansion and contraction in response to the pressure Ps' therein. The valve casing 31*b* is fitted in the valve-receiving space 44 which is formed in the rear side block 4 in communication with the passage 30. With such arrangement, when the auxiliary low-pressure Ps within the auxiliary low-pressure chamber 42 is above a predetermined value set by an adjusting screw member 31*e*, the bellows 31*a* is in a contracted state to bias the ball valve body 31*c* in a position closing a central hole 31*f* formed through the valve casing 31*b*. On the other hand, when the auxiliary low pressure Ps' is below the predetermined value, the bellows 31*a* is in an expanded state to bias the ball valve body 31*c* in a position opening the central hole 31*f*. In this open position of the valve, the aforementioned one second pressure chamber $26_2$ is communicated with the auxiliary low-pressure chamber 42 via the passage 30, the valve-receiving space 44, a pair of radial holes 31*g* formed in the valve casing 31*b*, a chamber 31*h* defined within the valve casing 31*b*, and the central hole 31*f*.

The control element 27 is urged in the clockwise direction as viewed in FIG. 5 by a torsion coiled spring 38 fitted around a hub of the rear side block 4 axially extending toward the suction chamber 11, as shown in FIGS. 1 and 5.

Thus, the control element 27 is rotatable in opposite directions in response to the difference between the sum of the suction pressure Ps introduced into the first pressure chambers $26_1$, $26_1$ and the urging force of the coiled spring 38, and the control pressure Pc within the second pressure chambers $26_2$, $26_2$. To be specific, the control pressure Pc within the second pressure chambers $26_2$, $26_2$ is controlled by means of the control valve device 31 so as to maintain the auxiliary low pressure Ps' at the predetermined value so that the control element 27 is rotated in opposite directions between two extreme positions, i.e., the maximum capacity position for obtaining the maximum delivery quantity or capacity of the compressor, as shown by the solid lines in FIG. 3, and the minimum capacity position for obtaining the minimum delivery quantity or capacity of the compressor, as shown by the two-dot chain lines in FIG. 3.

The operation of the compressor according to the invention constructed as above will now be explained.

When the auxiliary low-pressure Ps' within the auxiliary low-pressure chamber 42 is above the predetermined value and therefore the bellows 31*a* of the control valve device 31 is in a contracted state, the ball valve body 31*c* closes the central hole 31*f* of the valve casing 31*b*, as shown in FIG. 1. On this occasion, the control pressure Pc within the second pressure chambers $26_2$, $26_2$ into which the discharge pressure Pd is supplied through the restriction passage 40, is maintained at a high level, whereby the control pressure Pc overcomes the sum of the pressure Ps within the first pressure chambers $26_1$, $26_1$ and the force of the coiled spring 38, thereby rotating the control element 27 toward the maximum capacity position as shown by the solid lines in FIG. 3. In the maximum capacity position, the control element 27 assumes such a position that an upstream end $28_1$ of each cut-out portion 28 thereof with respect to the rotational direction of the rotor 2 is in an extreme downstream position, i.e., an extreme clockwise position of the control element 27 as viewed in FIG. 2, whereby the compression stroke commences at the earliest timing. Therefore, the volume of the refrigerant gas trapped within the compression chamber defined between the two successive vanes $14_1$–$14_2$ is the maximum, resulting in the maximum delivery quantity or capacity of the compressor.

On the other hand, when the auxiliary low pressure Ps' within the auxiliary low-pressure chamber 42 decreases below the predetermined value and therefore the bellows 31*a* of the control valve device 31 is brought into an expanded state, the ball valve body 31*c* opens the central hole 31*f* of the valve casing 31*b*. As a result, refrigerant gas having the control pressure Pc within the second pressure chambers $26_2$, $26_2$ flows through the passage 30, the valve-receiving space 44, the radial holes 31*g* of the valve casing 31*b*, the chamber 31*h* within the valve casing 31*b*, and the central hole 31*f* of the valve casing 31*b*, in the mentioned order, into the auxiliary low-pressure chamber 42. The refrigerant gas thus flowing into the auxiliary low-pressure chamber 42 further flows into the suction chamber 11 through the restriction hole 43. Consequently, the control pressure Pc within the second pressure chambers $26_2$, $26_2$ decreases below the sum of the pressure Ps within the first pressure chambers $26_1$, $26_1$ and the urging force of the coiled spring 38, thereby rotating the control element 27 from the aforementioned maximum capacity position toward the minimum capacity position as shown by the two-dot chain lines in FIG. 3. In the minimum capacity position, the control element 27 assumes such a position that the upstream end $28_1$ of each cut-out portion 28 is in an extreme upstream position, whereby the compression stroke commences at the most retarded timing. Therefore, the volume of the refrigerant gas trapped within the compression chamber defined between the two successive vanes $14_1$ and $14_2$ is the minimum, resulting in the minimum delivery quantity or capacity of the compressor.

Figure 6:
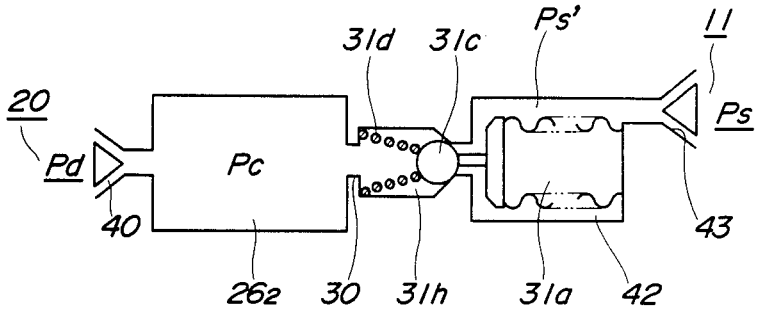
FIG. 6 is a view useful in explaining the operation of a control valve device of the compressor.

Now, reference is made to FIG. 6 schematically showing the capacity control system of the invention described above. Refrigerant gas under discharge pressure Pd flows from the passage 20 on the high-pressure side into the suction chamber 11 on the low-pressure side during opening of the control valve device 31. The flow rate Q of the refrigerant gas can be simply expressed by the following expression:

$$Q = \mu S \sqrt{Pd - Pc} = \mu' S' \sqrt{Ps' - Ps} \quad (1)$$

where S represents the cross-sectional area of the restriction passage 40, S' the cross-sectional area of the restriction hole 43, $\mu$ the coefficient of kinematic viscosity of refrigerant gas flowing through the restriction passage 40, and $\mu'$ the coefficient of kinematic viscosity of refrigerant gas flowing through the restriction hole 43, respectively.

The above expression (1) can be converted as follows with the respect to the pressure Ps:

$$Ps = Ps' - (\mu S/\mu' S')^2 (Pd - Pc) \quad (2)$$

The control pressure Pc falls within a given range of values, e.g., 3–8 kg/cm$^2$ so that the value (Pd−Pc) always assumes a positive value. Therefore, the expression (2) can be simplified as below to represent the relationship between the suction pressure Ps and the discharge pressure Pd:

$$Ps = -a \times Pd + b \quad (3)$$

where a represents $(\mu S/\mu' S')^2$ and Ps'.

From the expression (3), it will be understood that the suction pressure Ps decreases with increase of the discharge pressure Pd.

Specifically, for example, if the auxiliary low pressure Ps' is 2.2 kg/cm$^2$, S is 0.3 mm$^2$, and S' is 1.7 mm$^2$, when the discharge pressure Pd is 14 kg/cm$^2$ and the control pressure Pc is 4 kg/cm$^2$, the suction pressure Ps will be 1.89 kg/cm$^2$, and when the discharge pressure Pd is 7 kg/cm$^2$ and the control pressure Pc is 3 kg/cm$^2$, the suction pressure will be 2.076 kg/cm$^2$.

Figure 7:
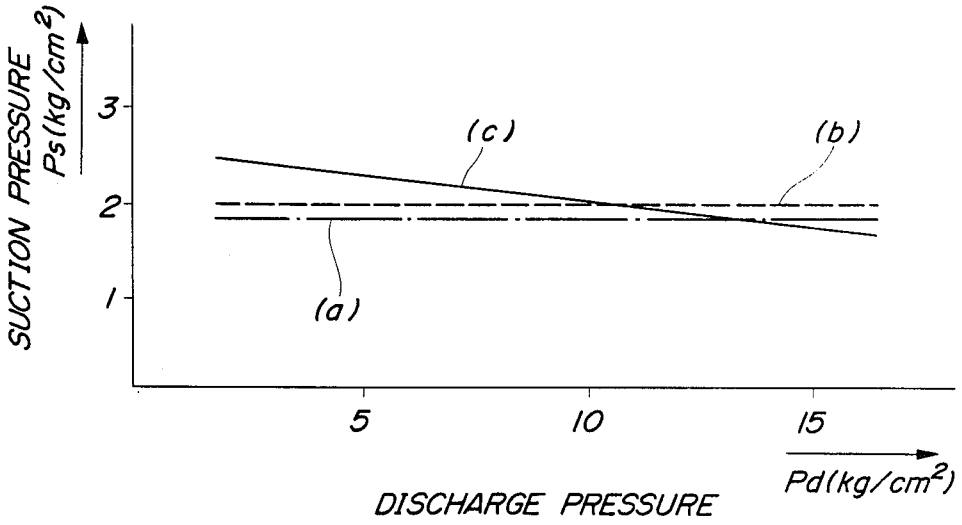
FIG. 7 is a graph showing the relationship between the discharge pressure Pd and the suction pressure Ps.

Thus according to the construction of the invention, the suction pressure Ps decreases with increase of the discharge pressure Pd or high pressure, and increases with decrease of the discharge pressure Pd, as shown by the solid line (c) in FIG. 7. Therefore, the pressure of the outlet of the evaporator little varies with change in the thermal load on the air conditioning system, thereby preventing the outlet of the evaporator from freezing up.

Figure 8:
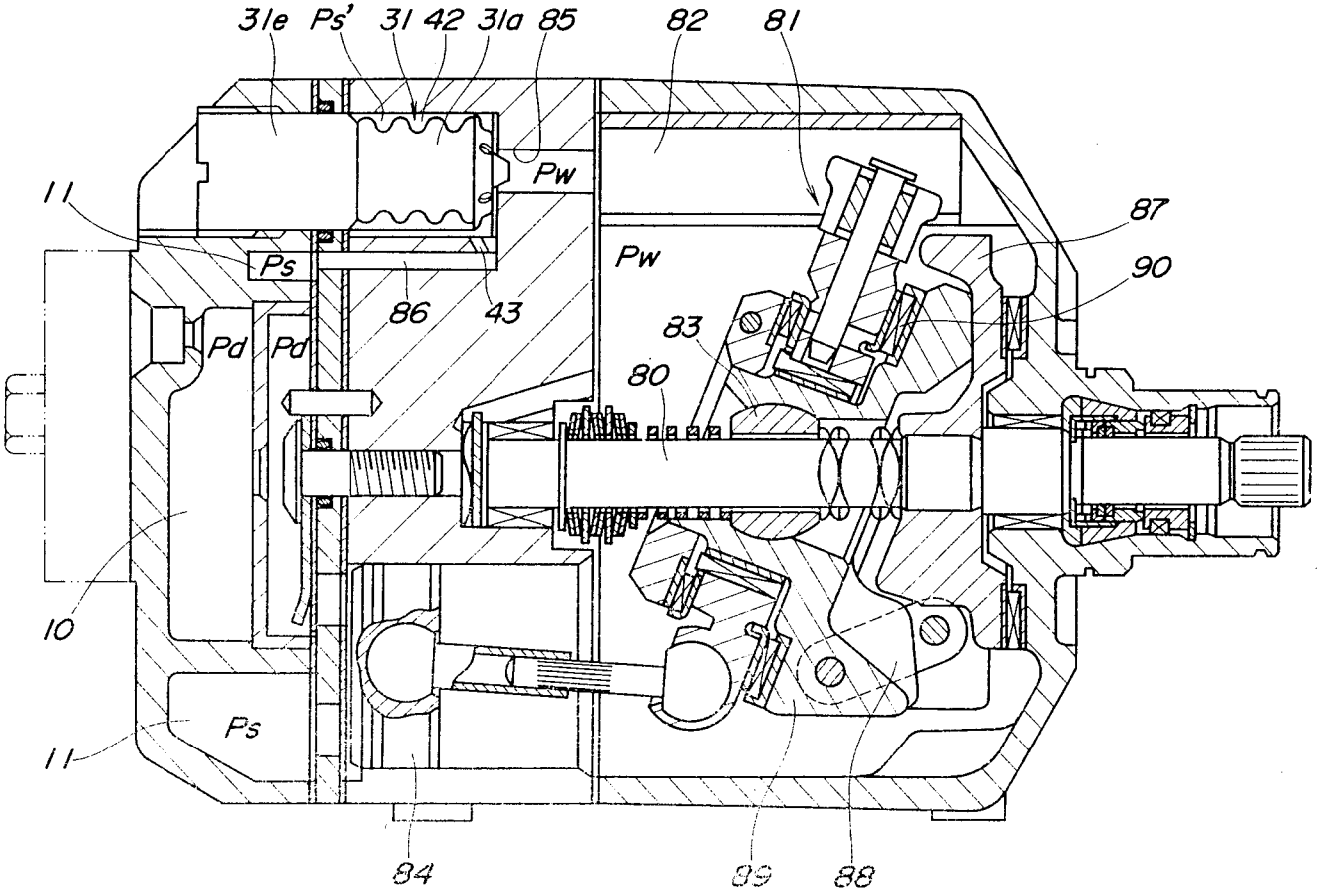
FIG. 8 is a longitudinal cross-sectional view of a wobble plate type variable capacity compressor according to a second embodiment of the invention.

FIG. 8 shows a second embodiment of the invention, in which the invention is applied to a wobble plate type variable capacity compressor.

According to the second embodiment, when a drive shaft 80 is rotatively driven by an engine installed on a vehicle, neither of which is shown, a rotary retainer 87 secured on the drive shaft 80 is rotated together therewith. The rotation of the rotary retainer 87 causes rotation of a support member 89 coupled thereto by a link arm 88 so that a nonrotatable wobble plate 81, which is in slidable contact with the support member 89 via a thrust bearing 90 but prohibited from rotation, is axially swung about a hinge ball 83 fitted on the drive shaft 80. During the swinging motion, the wobble plate 81 varies in angularity or angle of inclination with respect to the axis of the drive shaft 80 in response to pressure Pw within a crank chamber 82. Consequently, the stroke of slide of pistons 84 coupled to the wobble plate 81, only one of which is shown, is varied to cause a change in the delivery quantity or capacity of the compressor. To be specific, the inclination angle of the wobble plate 81 increases with decrease of the pressure Pw within the crank chamber 82, thereby increasing the stroke of slide of the pistons 84 and hence the delivery quantity or capacity. Conversely, the inclination angle of the wobble plate 81 decreases with increase of the pressure Pw within the crank chamber 82, thereby decreasing the stroke of slide of the pistons 84 and hence the delivery quantity or capacity.

The compressor is provided with a control valve device 31 for regulating the pressure Pw within a crank chamber 82 in response to the suction pressure Ps within a suction chamber 11. The control valve device 31 has a flexible bellows 31*a* as a pressure-responsive element disposed within an auxiliary low-pressure chamber 42 communicating with the crank chamber 82 via a passage 85, for expansion and contraction in response to auxiliary low pressure Ps' within the chamber 42. The auxiliary low-pressure chamber 42 also communicates with the suction chamber 11 via a passage 86 and a restriction hole 43.

In the variable capacity wobble plate type compressor constructed as above, the bellows 31*a* of the control valve device 31 expands to close the communication passage 85 when auxiliary low pressure Ps' within the auxiliary low-pressure chamber 42 is below a predetermined value. On this occasion, the pressure Pw within the crank chamber 82 is not allowed to leak into the suction chamber 11 so that blow-by gas from pumping chambers within piston cylinders is accummulated within the crank chamber 82, thereby increasing the pressure Pw therein and hence decreasing the delivery quantity or capacity as mentioned above.

When the auxiliary low pressure Ps' within the auxiliary low-pressure chamber 42 is above the predetermined value, the bellows 31*a* of the control valve device 31 contracts to open the passage 85. On this occasion, refrigerant gas under pressure Pw within the crank chamber 82 is allowed to flow into the suction chamber 11 through the open passage 85, the auxiliary low-pressure chamber 42, the restriction hole 43, and the passage 86, thereby decreasing the pressure Pw within the crank chamber 82 and hence increasing the delivery quantity or capacity as mentioned above. In this way, the delivery quantity or capacity is controlled so as to maintain the auxiliary low pressure Ps' at the predetermined value.

As noted above, the refrigerant gas flows from the crank chamber 82 as a high-pressure chamber into the suction chamber as a low-pressure chamber during opening of the control valve device 31. The relationship between the suction pressure Ps and the pressure Pw can be simply represented by the following expression (4), similarly to the expression (3).

$$Ps = -a \times Pw + b \quad (4)$$

where a represents $(\mu S/\mu' S')^2$, and b the auxiliary low pressure Ps', S being the cross-sectional area of the communication passage 85, and S' the cross-sectional area of the restriction hole 43, respectively.

Therefore, also in the second embodiment, the suction pressure Ps decreases with increase of the pressure Pw within the crank chamber 82, and increases with decrease of the pressure Pw, similarly to the first embodiment. Therefore, the pressure of the outlet of the evaporator little varies even when the thermal load on the air conditioning system changes, thereby preventing freeze-up of the outlet of the evaporator at low thermal load on the system.

What is claimed is:

1. In a variable capacity compressor for an air conditioning system, including a suction chamber communicating with an outlet of an evaporator of said air conditioning system, a high-pressure chamber, passage means extending between said suction chamber and said high-pressure chamber, control valve means arranged in said passage means for opening and closing same, said control valve means having pressure-responsive means displaceable in response to change in pressure within said passage means, and capacity control means responsive to opening and closing of said passage means by said control valve means for controlling the delivery quantity of said compressor, wherein said control valve means opens and closes said passage means in response to change in pressure within said suction chamber, representative of a thermal load on said air conditioning system to thereby cause said capacity control means to vary the delivery quantity of said compressor, the improvement comprising:

an auxiliary low-pressure chamber, within which said pressure-responsive means is disposed; and restriction hole means communicating said suction chamber with said auxiliary low-pressure chamber for introducing pressure within said suction chamber into said auxiliary low-pressure chamber.

2. A variable capacity compressor as claimed in claim 1, wherein said compressor has a pressure working space defined therein, and a control element having a pressure-receiving portion slidably received in said pressure working space to divide same into a first pressure chamber, and a second pressure chamber forming said high-pressure chamber, said first pressure chamber communicating with said suction chamber to be supplied with the pressure within said suction chamber, said second pressure chamber communicating with said auxiliary low-pressure chamber through said control valve means whereby pressure within said second pressure chamber leaks into said auxiliary low-pressure chamber when said control valve means is open, said control element being displaceable in response to the difference in pressure between said first pressure chamber and said second pressure chamber.

3. A variable capacity compressor as claimed in claim 2, wherein said compressor is a vane compressor having a rotor, and vanes carried by said rotor, said control element being rotatable in response to the difference in pressure between said first pressure chamber and said second pressure chamber for varying the timing of commencement of compression of refrigerant trapped between two successive vanes.

4. A variable capacity compressor as claimed in any one of claims 1–3, wherein said pressure-responsive means comprises a bellows being displaceable in response to pressure within said auxiliary low-pressure chamber in a manner such that it closes said passage means when the pressure within said auxiliary low-pressure chamber is above a predetermined value and opens said passage means when the pressure within said auxiliary low-pressure chamber is below said predetermined value.

* * * * *